US011311910B2

(12) United States Patent
Hai et al.

(10) Patent No.: US 11,311,910 B2
(45) Date of Patent: Apr. 26, 2022

(54) HIGH-EFFICIENCY WATER-SAVING SEPARATION SCREEN FOR STARCH SLURRY AND RESIDUE AND SEPARATION METHOD

(71) Applicant: Anhui Academy of Environmental Science Research, Hefei (CN)

(72) Inventors: Zibin Hai, Hefei (CN); Xiqiang Zheng, Hefei (CN); Wu Kuang, Hefei (CN); Zhi Huang, Hefei (CN); Hao Yu, Hefei (CN); Xiangyu Wang, Hefei (CN); Ruizhe Lv, Hefei (CN)

(73) Assignee: ANHUI ACADEMY OF ENVIRONMENTAL SCIENCE RESEARCH, Hefei (CN)

( * ) Notice: Subject to any disclaimer, the term of this patent is extended or adjusted under 35 U.S.C. 154(b) by 0 days.

(21) Appl. No.: 17/374,032

(22) Filed: Jul. 13, 2021

(65) Prior Publication Data

US 2021/0339283 A1 Nov. 4, 2021

Related U.S. Application Data

(63) Continuation of application No. PCT/CN2020/122507, filed on Oct. 21, 2020.

(30) Foreign Application Priority Data

Oct. 24, 2019 (CN) ..... 201911019404.4

(51) Int. Cl.

| | |
|---|---|
| ***B07B 1/24*** | (2006.01) |
| ***B07B 1/42*** | (2006.01) |
| ***B07B 1/55*** | (2006.01) |

(52) U.S. Cl.

CPC ..... *B07B 1/24* (2013.01); *B07B 1/42* (2013.01); *B07B 1/55* (2013.01); *B07B 2230/01* (2013.01)

(58) Field of Classification Search

CPC .... B07B 1/20; B07B 1/24; B07B 1/42; B07B 1/55; B07B 2230/01

(Continued)

(56) References Cited

U.S. PATENT DOCUMENTS 1,845,441 A * 2/1932 Robertson ..... B07B 4/06 209/34
2,089,215 A * 8/1937 Lomax ..... A47J 43/145 99/495

(Continued)

FOREIGN PATENT DOCUMENTS

CN 204162690 U 2/2015
CN 204474564 U 7/2015

(Continued)

OTHER PUBLICATIONS

English Translation of CN 107940911 A; Inv/Assignee: Anhui Saiyue Environmental Tech; Pub Date: Apr. 2018 (Year: 2018).*

(Continued)

*Primary Examiner* — Joseph C Rodriguez
(74) *Attorney, Agent, or Firm* — Muncy, Geissler, Olds & Lowe, PC

(57) ABSTRACT

The present disclosure relates to the technical field of food equipment design and processing, and provides a high-efficiency water-saving separation screen for starch slurry and residue which includes a horizontal screen drum, a screen mesh, a screw propelling extrusion rod, a rotation drive unit and a flushing spray pipe; one side of the horizontal screen drum is provided with a feeding inlet, and the other side of the horizontal screen drum is provided with a slurry outlet and a residue outlet; the screen mesh is in a cone shape, and the cross-sectional diameter of the screen mesh gradually decreases from the feeding inlet to the residue outlet; the screw propelling extrusion rod is arranged in the screen mesh and includes a screw propelling extrusion rod (Continued)

shaft and a screw blade; the rotation drive unit drives the screen mesh and the screw propelling extrusion rod to rotate in opposite directions; and the flushing spray pipe is used for flushing slurry and residue on the screen drum. The present disclosure further provides a separation method adopting the aforementioned separation screen. The synergistic effects of mechanical disturbance and hydraulic overflow washing and screening are simultaneously exerted by the screen, compared with traditional curved surface screens and high-speed centrifugal screens, the usage amount of clean water and the generation amount of wastewater can be reduced, and the concentration of obtained starch slurry is increased; and the moisture content of potato residue extruded and separated out by the screen is low, and thus subsequent utilization is facilitated.

6 Claims, 2 Drawing Sheets

(58) Field of Classification Search
USPC ..... 209/279, 280
See application file for complete search history.

(56) References Cited

U.S. PATENT DOCUMENTS 3,622,006 A * 11/1971 Brunner ..... B01D 35/14 210/355
4,368,125 A * 1/1983 Murray ..... B01D 35/22 210/374
5,091,077 A * 2/1992 Williams ..... B07B 4/06 209/23
RE34,458 E * 11/1993 Fahrenholz ..... B02C 17/002 209/234
5,348,162 A * 9/1994 Wroblewski ..... B07B 1/24 209/35
5,435,917 A * 7/1995 Sato ..... B01D 33/801 210/374
6,338,411 B1 * 1/2002 katabe ..... B01D 33/275 210/383
7,344,637 B2 * 3/2008 Frommann ..... E03F 5/14 210/158

FOREIGN PATENT DOCUMENTS

| | | | |
|---|---|---|---|
| CN | 105618367 | A | 6/2016 |
| CN | 206276600 | U | 6/2017 |
| CN | 206316010 | U | 7/2017 |
| CN | 107940911 | A | 4/2018 |
| CN | 208373517 | U | 1/2019 |
| CN | 110721896 | A | 1/2020 |
| CN | 211436921 | U | 9/2020 |
| EP | 0955101 | A2 | 11/1999 |
| JP | H-088506729 | A | 7/1996 |
| WO | WO-9418856 | | 9/1994 |

OTHER PUBLICATIONS

Office Action dated Oct. 27, 2021 in CN Application No. 201911019404.4, 19 pages.

* cited by examiner

HIGH-EFFICIENCY WATER-SAVING SEPARATION SCREEN FOR STARCH SLURRY AND RESIDUE AND SEPARATION METHOD

CROSS REFERENCE TO RELATED APPLICATIONS

This application is a By-Pass Continuation of Application No. PCT/CN2020/122507, filed on Oct. 21, 2020, for which priority is claimed under 35 U.S.C. § 120; and this application claims priority of Application No. CN 201911019404.4 filed in China on Oct. 24, 2019 under 35 U.S.C. § 119, the entire contents of all of which are hereby incorporated by reference.

FIELD

The present disclosure relates to the technical field of food equipment design and processing, in particular to a high-efficiency water-saving separation screen for starch slurry and residue and a separation method.

BACKGROUND

Starch processing includes processing of potato starch, cereal starch, legume starch and the like. Slurry-residue screening is an important link in starch processing technology. The principle is to separate free starch granules from starch residue under the action of water flow, so that the starch granules enter the fluid phase to provide conditions for starch extraction and refining; and the starch residue enters the solid phase and is collected for other purposes.

The difference in particle size between starch granules and starch residue is the principle basis for the separation of starch and starch residue through a screen mesh. At the same time, the starch slurry composed of crushed starch granules and starch residue is high in viscosity, and needs to be screened under the action of water power.

The traditional starch slurry and residue curved mesh separation screen needs to consume a large amount of clean water to flush the starch slurry and residue on the screen inside surface, and the clean water flows through the screen in one time and reaches the position below the screen without a repeated washing process, resulting in low water utilization rate.

A horizontal high-speed centrifugal cone screen used in a starch production line with a high automation degree can use the centrifugal force generated by high-speed rotation to improve the screening efficiency and reduce the usage amount of clean water. However, the high centrifugal force requires the potato residue and other substances attached to the screen mesh to be back flushed regularly, otherwise the screening efficiency will gradually decrease due to the blockage of the screen mesh. In addition, the conical screen generally includes a steel structure and a steel screen mesh, which is large in weight and not convenient for replacement and maintenance. Lots of energy is consumed for driving the cone screen to rotate at high speed.

Therefore, designing a low-speed rotating screening equipment with a mechanical brush disturbing screen mesh and repeatedly washing starch slurry and residue on the screen surface is of great significance for saving water in the starch processing industry and reducing starch processing wastewater discharge.

SUMMARY

The present disclosure aims to overcome the defects of the prior art, and provides a high-efficiency water-saving separation screen for starch slurry and residue and a separation method to solve the problems of large water consumption and large generation amount of starch wastewater caused by existing starch slurry and residue screening devices.

The present disclosure adopts the following technical solutions:

a high-efficiency water-saving separation screen for starch slurry and residue includes a horizontal screen drum, a screen mesh, a screw propelling extrusion rod, a rotation drive unit and a flushing spray pipe;

one side of the horizontal screen drum is provided with a feeding inlet, and the other side of the horizontal screen drum is provided with a slurry outlet and a residue outlet;

the screen mesh is arranged in the horizontal screen drum and is in a cone shape, and the cross-sectional diameter of the screen mesh gradually decreases from the feeding inlet side to the residue outlet side; and the screen mesh can rotate around the center axis (coaxial with the screw propelling extrusion rod) of the screen mesh;

the screw propelling extrusion rod is arranged in the screen mesh and is coaxial with the screen mesh; the screw propelling extrusion rod includes a screw propelling extrusion rod shaft and a screw blade, and the size of the screw blade is matched with the cross-sectional size of the screen mesh;

the rotation drive unit is used for driving the screen mesh and the screw propelling extrusion rod respectively to rotate in opposite directions; and the flushing spray pipe is used for flushing slurry and residue on the screen drum.

Further, a screw propelling brush is installed on the outer side of the screen mesh, and the screw propelling brush can rotate synchronously with the screen mesh. The screw propelling brush is used for propelling starch slurry in the screen drum to discharge outlets.

Further, the rotation drive unit is fixed outside the wall of the horizontal screen drum at the feeding inlet end, and the rotation drive unit includes two coaxial parallel driving wheels which are respectively connected to a screw propelling extrusion rod driven wheel and a screen mesh driven wheel sleeving the screw propelling extrusion rod shaft through belts.

Further, the screen mesh is supported by a plurality of rings of different diameters and cross bars connecting the rings, the rings are connected to a bearing sleeving the screw propelling extrusion rod shaft through a plurality of spokes, and the bearing is driven by the rotation drive unit to rotate.

Further, the screen mesh is made of high-strength nylon or steel wires or alloy steel wires, and the hole size of the screen mesh is between 120 mesh and 140 mesh.

Further, a spacing between the screw blades and a space between the screw propelling extrusion rod and the screen mesh are gradually decreases towards the discharge outlet end, the moisture content of the discharged potato residue is reduced, and the yield of starch is increased by extruding wet potato residue through the screw blade, the screen mesh and the wall of the screen drum.

Further, the flushing spray pipe is arranged at the top of the horizontal screen drum, and the flushing spray pipe is provided with spray nozzles. The density of the spray nozzles is increased towards the discharge outlets.

Further, a main body of the screw blade is made of steel, and is coated with a wear-resistant rubber layer.

Further, the bottommost portion of the horizontal screen drum at the slurry outlet end is provided with a complete emptying valve.

Further, the horizontal height of the slurry outlet is located between the highest horizontal position and the lowest horizontal position of the screen mesh, and the feeding inlet is located at the middle-upper part of the horizontal screen drum.

Further, the horizontal screen drum is installed on a base.

The present disclosure further provides a high-efficiency water-saving starch slurry and residue separation method adopting the above-mentioned high-efficiency water-saving separation screen for starch slurry and residue, and the method specifically includes:

enabling starch slurry and residue to enter the screen mesh of the horizontal screen drum from the feeding inlet, and enabling the screen mesh and the screw propelling extrusion rod to rotate in opposite directions under the action of the drive unit;

enabling starch with small granules in starch slurry and residue to pass through the screen mesh with water flow, enabling potato residue to remain in the screen mesh, and enabling starch continuously to pass through the screen mesh under the actions of rolling of the screen mesh and the screw propelling extrusion rod;

enabling the screened-out potato residue to continuously move toward the residue outlet under the push of the screw propelling extrusion rod; enabling the potato residue on the screen mesh to leave the starch slurry liquid level as the horizontal position of the cone-shaped screen mesh surface rises, and washing the slurry and residue on the screen mesh through the flushing spray pipe for enabling starch granules in the slurry and residue to pass through the screen mesh; and extruding the potato residue in the screen mesh by the continuously retracting screw blade and the screen mesh, and discharging the potato residue finally from the residue outlet of the screen drum as the moisture in the potato residue is reduced; and discharging the starch from the slurry outlet.

Further, when the screening operation is completed, the complete emptying valve is opened to discharge all the starch slurry and potato residue.

The beneficial effects of the present disclosure are as follows:

(1) The present disclosure adopts a screw propelling blade instead of hydraulic action to make the slurry and the residue move relatively on the screen mesh, which solves the problems of large water consumption and large generation amount of starch wastewater caused by traditional curved surface screens.

(2) By adopting a horizontal screen drum overflow washing device of the present disclosure, the slurry and residue cleaning water can fully interact with the slurry and the residue, the defects of traditional screening devices that the cleaning water only plays a one-time screening role, the cleaning water consumption is high, and the Baume degree of starch slurry below the screen is low are overcome, and then the burden of subsequent starch extraction is reduced.

(3) The screw propelling extrusion blade and the screen drum adopted by the present disclosure can extrude the wet potato residue, so that the moisture content of the potato residue is greatly lowered, and the amount of starch lost with the potato residue is reduced. The starch extraction rate of sweet potato starch processing is increased.

Figure 1:
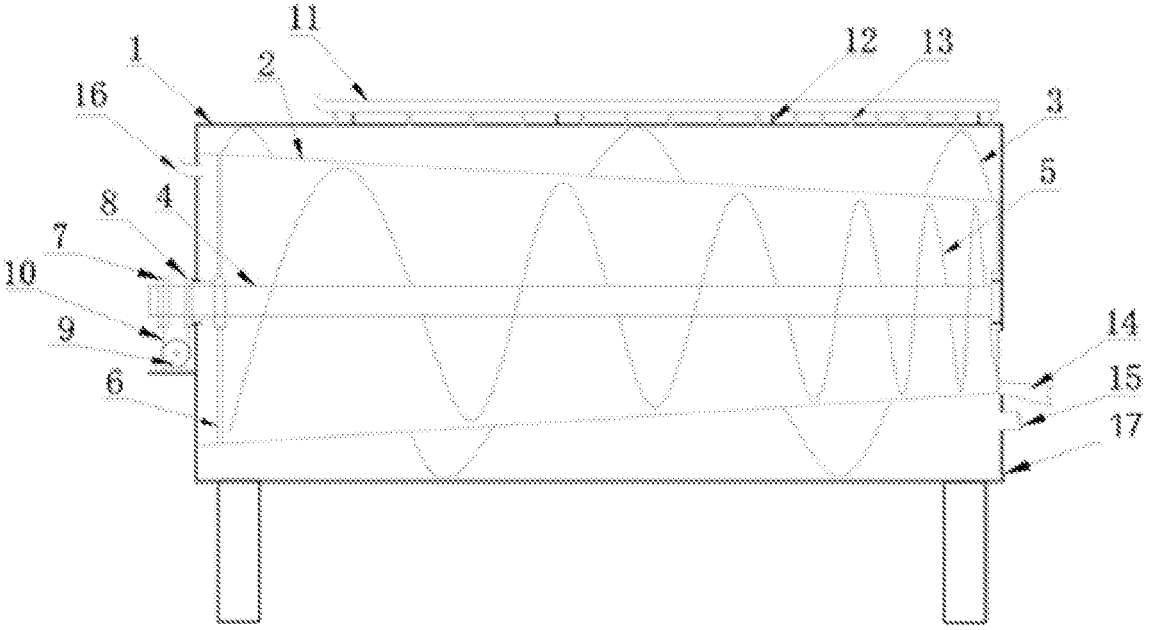
FIG. 1 is a schematic structural diagram of a high-efficiency water-saving separation screen for starch slurry and residue according to an embodiment of the present disclosure.

Wherein, 1. Horizontal screen drum, 2. Screen mesh, 3. Screw propelling brush (blade outside screen mesh), 4. Screw propelling extrusion rod, 5. Screw blade, 6. Spoke for screen mesh supporting ring, 7. Extrusion rod driven wheel, 8. Screen mesh driven wheel, 9. Rotation drive unit, 10. Belt, 11. Flushing spray pipe (clean water pipe), 12. Fixing column, 13. Clean water inlet hole, 14. Residue outlet, 15. Slurry outlet, 16. Feeding inlet, 17. Complete emptying valve.

DETAILED DESCRIPTION OF THE EMBODIMENTS

Specific embodiments of the present disclosure will be described in detail with reference to specific accompanying drawings below. It should be noted that the technical features or combinations of technical features described in the following embodiments should not be considered as isolated, and they can be combined with each other to achieve better technical effects. In the accompanying drawings of the following embodiments, the same reference numerals appearing in the accompanying drawings represent the same features or components, which can be applied to different embodiments.

As shown in FIG. 1, an embodiment of the present disclosure provides a high-efficiency water-saving separation screen for starch slurry and residue which includes a horizontal screen drum 1, a screen mesh 2, a screw propelling extrusion rod 4, a rotation drive unit 9, a flushing spray pipe 11 and a base.

Figure 3:
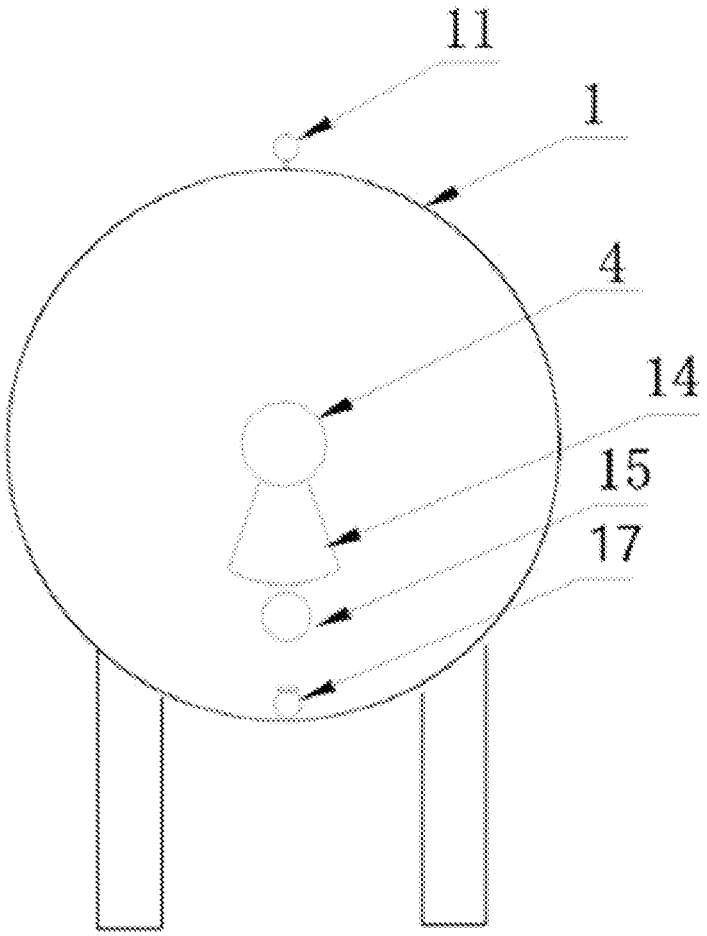
FIG. 3 is a schematic side view (a slurry outlet end) of an embodiment.

Preferably, the horizontal screen drum 1 is installed on the base. A feeding inlet 16 is arranged at one side of the horizontal screen drum 1, a slurry outlet 15 and a residue outlet 14 are arranged at the other side of the horizontal screen drum 1, the horizontal height of the slurry outlet 15 is located between the highest horizontal position and the lowest horizontal position of the screen mesh 2, and the feeding inlet 16 is located at the middle-upper part of the horizontal screen drum 1. The bottommost portion of the horizontal screen drum 1 is provided with a complete emptying valve 17 located below the slurry outlet 15, as shown in FIG. 3.

Preferably, the screen mesh 2 is in a cone shape, and is supported by a plurality of rings of different diameters and cross bars connecting the rings, the rings for supporting are connected to a bearing sleeving the screw propelling extrusion rod 4 through a plurality of spokes 6, and the bearing is connected to the rotation drive unit 9. It should be noted that the screen mesh 2 and the screw propelling extrusion rod 4 may be connected in a variety of ways, which is not limited to the preferred embodiment, as long as the screen mesh 2 and the screw propelling extrusion rod shaft can coaxially rotate in opposite directions.

The diameter of the screen mesh 2 is gradually decreased towards the residue outlet 14, and a screw propelling brush 3 is installed on the outer side of the screen mesh 2 and can propel starch slurry in the horizontal screen drum 1 to the slurry outlet 15. Slurry and residue on the screen mesh 2 are flushed by the flushing spray pipe 11 at the top of the horizontal screen drum 1. The closer to the residue outlet 14, the larger the density of spray nozzles. The flushing spray pipe 11 can be fixed at the top of the horizontal screen drum 1 through fixing columns 12, and communicates with the interior of the horizontal screen drum 1 through clean water inlet holes 13.

The screen mesh 2 is preferably made of high-strength nylon or steel wires or alloy steel wires, and the mesh size of the screen mesh 2 is between 120 mesh and 140 mesh.

The screw propelling extrusion rod 4 is connected with the rotation drive unit 9, and the rotating direction of the screw propelling extrusion rod 4 is opposite to the screen mesh 2, which leads the potato residue in the screen mesh 2 are propelled and extruded from the residue outlet 14.

The spacing of the screw blade 5 of the screw propelling extrusion rod 4 and the space between the screw propelling extrusion rod 4 and the screen mesh 2 are decreased gradually towards the residue outlet 14, the moisture content of the discharged potato residue is lowered, and the yield of starch is increased by extruding wet potato residue by the screw blade 5, the screen mesh 2 and the wall of the horizontal screen drum 1. A main body of the screw blade 5 is made of steel, and is preferably covered with a wear-resistant rubber layer.

Figure 2:
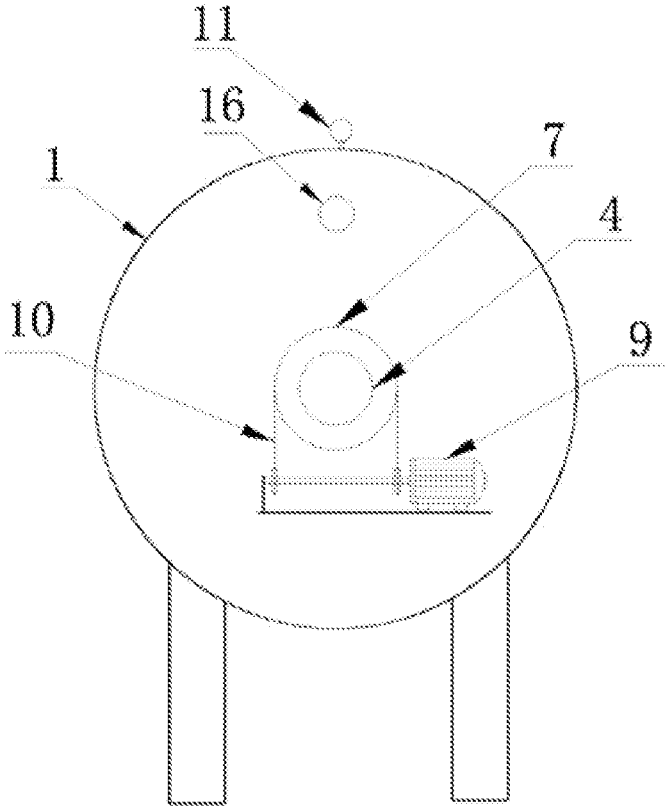
FIG. 2 is a schematic side view (a feeding inlet end) of an embodiment.

As shown in FIG. 2, the rotation drive unit 9 is used for driving the screen mesh 2 and the screw propelling extrusion rod 4, and can adopt a variety of drive modes. The rotation drive unit 9 is preferably fixed outside the wall of the horizontal screen drum 1 at the feeding inlet 16 end and provided with two coaxial parallel driving wheels which are respectively connected to a screw propelling extrusion rod driven wheel 7 and a screen mesh driven wheel 8 sleeving a screw propelling extrusion rod shaft through belts 10.

An embodiment of the present disclosure provides a high-efficiency water-saving starch slurry and residue separation method adopting the above-mentioned high-efficiency water-saving separation screen for starch slurry and residue, and the method specifically includes:

1. A machine is turned on, a complete emptying valve 17 is closed, starch slurry and residue enter a screen drum 1 from a feeding inlet 16, and a screen mesh 2 and a screw propelling extrusion rod 4 start to rotate under the action of a drive unit 9.

2. On the screen mesh 2, part of the starch with small granules in the starch slurry and residue pass through the screen mesh 2 with water flow, remaining slurry and residue remain on the screen mesh 2, and then starch is continuously pass through the screen mesh 2 under the combined action of rolling of the screen mesh 2 and the screw propelling extrusion rod 4.

3. Below the screen mesh 2, the starch slurry level keeps rising until the liquid level reaches the horizontal position of a slurry outlet 15, and then the starch slurry begins to overflow and be discharged. When the starch slurry is at the highest liquid level, a section of screen mesh 2 at the feeding inlet 16 end can be submerged. The starch slurry and residue on the submerged screen mesh 2 can be washed repeatedly to separate most of the starch granules from the potato residue. A screw propelling brush (blade outside screen mesh) 3 on the periphery of the screen mesh 2 pushes the starch slurry to move toward the slurry outlet 15 to prevent the starch slurry from accumulating.

4. The screened-out potato residue continuously moves toward a residue outlet under the push of the screw propelling extrusion rod 4. As the horizontal position of the cone-shaped screen mesh surface rises, the potato residue on the screen mesh 2 leaves the slurry liquid level, at this time, the slurry and residue on the screen mesh 2 are washed by spray nozzles of the flushing spray pipe (clean water pipe) 11 to further enable the starch granules in the slurry and residue to pass through the screen mesh 2.

5. The potato residue on the screen mesh 2 is extruded by the continuously retracting screw blade 5 and the screen mesh 2, so that the moisture in the potato residue is reduced, and the potato residue is finally discharged from the residue outlet 14 of the screen drum 1.

6. When the screening operation is completed, the complete emptying valve 17 is opened, and the machine is turned off when all the starch slurry and the potato residue are discharged.

The following table shows the comparison results of the present disclosure and a traditional curved mesh screen:

| Item | Separation screen of the present disclosure | Traditional curved mesh screen |
|---|---|---|
| Cleaning water consumption (tons of clean water/tons of fresh potatoes) | ≤0.8 | ≥1.5 |
| Baume degree of starch slurry (°Bé) | ≥6.5 | ≤3.5 |
| Moisture content of potato residue (%) | ≤89 | ≥94 |

According to the present disclosure, the screen mesh and the screw propelling extrusion rod rotate to propel the starch slurry below the screen and the potato residue above the screen to move toward discharge outlets (the residue outlet and the slurry outlet), and the synergistic effects of mechanical disturbance and hydraulic overflow washing and screening are exerted. Compared with traditional curved mesh screens and high-speed centrifugal screens, the separation screen can reduce the usage amount of clean water and the generation amount of wastewater, and the concentration of obtained starch slurry is increased. Meanwhile, the moisture content of the potato residue separated out by the screen through extrusion is low, and subsequent resource utilization is facilitated.

Although several embodiments of the present disclosure have been given herein, those skilled in the art should understand that the embodiments herein can be changed without departing from the spirit of the present disclosure. The above-mentioned embodiments are only exemplary, and the embodiments herein should not be used as a limitation to the scope of the present disclosure.

What is claimed is:

1. A high-efficiency water-saving separation screen for starch slurry and residue, comprising:

a horizontal screen drum, one side of the horizontal screen drum being provided with a feeding inlet, and an other side of the horizontal screen drum being provided with a slurry outlet and a residue outlet;

a screen mesh, arranged in the horizontal screen drum, having a cone shape, with a cross-sectional diameter of the screen mesh gradually decreasing along an axis of the cone from the feeding inlet to the residue outlet, wherein the slurry outlet is provided on a position vertically between highest and lowest points of the screen mesh;

a screw propelling brush, fixed on an outer side of the screen mesh to rotate synchronously with the screen mesh;

a screw propelling extrusion rod, arranged in the screen mesh and being coaxial with the screen mesh, including a screw propelling extrusion rod shaft and screw blades, with a first space between the screw blades and a second space between the screw propelling extrusion rod and the screen mesh both gradually decreasing towards the slurry outlet and the residue outlet;

a rotation drive unit, configured to drive the screen mesh and the screw propelling extrusion rod respectively to rotate in opposite directions; and a flushing spray pipe, arranged at a top of the horizontal screen drum, including multiple spray nozzles, with a density of the spray nozzles increasing towards the side with the slurry outlet and the residue outlet.

2. The high-efficiency water-saving separation screen for starch slurry and residue according to claim 1, wherein the rotation drive unit is fixed outside a wall of the horizontal screen drum at the feeding inlet end, and the rotation drive unit comprises two coaxial parallel driving wheels which are respectively connected to a driven wheel of the screw propelling extrusion rod and a screen mesh driven wheel sleeving the screw propelling extrusion rod shaft through belts.

3. The high-efficiency water-saving separation screen for starch slurry and residue according to claim 1, wherein the screen mesh is supported by a plurality of rings of different diameters and cross bars connecting the rings, the rings are connected to a bearing sleeving the screw propelling extrusion rod shaft through a plurality of spokes, and the bearing is driven by the rotation drive unit to rotate.

4. The high-efficiency water-saving separation screen for starch slurry and residue according to claim 1, wherein the screen mesh is made of high-strength nylon or steel wires or alloy steel wires, and a hole size of the screen mesh is between 120 mesh and 140 mesh.

5. The high-efficiency water-saving separation screen for starch slurry and residue according to claim 1, wherein a main body of each of the screw blades is made of steel, and is coated with a wear-resistant rubber layer.

6. The high-efficiency water-saving separation screen for starch slurry and residue according to claim 1, wherein a bottommost portion of the horizontal screen drum at the slurry outlet end is provided with a complete emptying valve.

* * * * *